US006000372A

United States Patent [19]

Moser

[11] Patent Number: 6,000,372

[45] Date of Patent: Dec. 14, 1999

[54] CYLINDER HEAD FOR USE FOR CRANKCASE HAVING VARIOUS CYLINDER-BORE DIAMETERS

[75] Inventor: Franz Xaver Moser, Kürten, Germany

[73] Assignee: Deutz AG, Cologne, Germany

[21] Appl. No.: 09/114,961

[22] Filed: Jul. 13, 1998

[30] Foreign Application Priority Data

Aug. 6, 1997 [DE] Germany ..... 197 34 007

[51] Int. Cl.[6] ..... F02F 1/24

[52] U.S. Cl. ..... 123/193.5

[58] Field of Search ..... 123/193.5, 193.1, 123/188.1

[56] References Cited

U.S. PATENT DOCUMENTS

| | | | |
|---|---|---|---|
| 2,696,810 | 12/1954 | Kuepfer | 123/188.8 |
| 5,390,634 | 2/1995 | Walters et al. | 123/193.5 |
| 5,431,137 | 7/1995 | Elsbett et al. | 123/193.5 |
| 5,551,393 | 9/1996 | Amano et al. | 123/193.5 |

FOREIGN PATENT DOCUMENTS 38 41 355 6/1990 Germany .

*Primary Examiner*—Marguerite McMahon

*Attorney, Agent, or Firm*—Nexsen Pruet Jacobs & Pollard, LLP; Charles L. Schwab, Esq.

[57] ABSTRACT

A single cylinder head design used for a series of engines using different cylinder bore diameters with a small diversity of parts. The cylinder head mounting holes and the valve stem guide openings for the breathing valves 4, 4*a* are the same for the series of engines. The cylinder head 2 is designed for the internal combustion engine of the series having the largest cylinder, wherein the valve disks 6 extend into the cylinder peripheral region of the part of the cylinder head 2 cooperating with the cylinder in forming the combustion chamber. When the cylinder head 2 is used for a small bore diameter engine of the series, the cylinder head is equipped with valve seat inserts 7*a* having a small diameter valve seating face and the valves have a corresponding smaller diameter complimentary seating face.

6 Claims, 1 Drawing Sheet

CYLINDER HEAD FOR USE FOR CRANKCASE HAVING VARIOUS CYLINDER-BORE DIAMETERS

TECHNICAL FIELD

This invention relates to an internal combustion engine of the type having a crankcase with at least one cylinder and a rotatable crankshaft to which at least one connecting rod is pivotally connected and in turn is connected to a piston which reciprocates in the cylinder. The cylinder is covered by a cylinder head so as to form a combustion chamber and the cylinder head carries intake and exhaust valves which seat in valve seat inserts.

BACKGROUND OF THE INVENTION

An internal combustion engine design is disclosed in German patent document DE-PS 38 41 355 in which increased engine displacement is achieved by increasing the spacing of the cylinders and by increasing the cylinder diameters. This prior design requires the redesign of all essential parts of the internal combustion engine and, moreover, necessitates the adaptation of existing production facilities. If production of the smaller displacement internal combustion engine is continued, all the parts of the smaller displacement internal combustion engine must continue to be built, and thus, a large diversity of parts and corresponding inventory is required.

OBJECTS AND SUMMARY OF THE INVENTION

It is an object of the invention to provide an internal combustion engine design by which engines of various displacements can be constructed with a small diversity of parts.

In the preferred embodiment of the invention, the crankcase of the internal combustion engine is designed for a variety of cylinder bore sizes and a basic cylinder head design is provided for all crankcase versions in which the cylinder head bolt openings and the valve stem openings are the same for the various cylinder bore versions of the engine. Thus a single basic cylinder head design can be used for a series of internal combustion engines and all the essential parts for attachment to the cylinder head are the same for all the engine sizes of the series.

The cylinder head is designed for the internal combustion engine having the largest cylinder bore, so that the breathing valve disks can extend, upon opening, into the cylinder peripheral region of the combustion chamber, and so that the cylinder head can be fitted with valve seat rings or inserts that effect a reduction of the valve disk diameter adapted to a smaller cylinder bore of a smaller displacement internal combustion engine of the engine series. The peripheral regions of these valve seat inserts are covered by the edge of the cylinders or the cylinder liners in the regions nearest one another; the breathing (intake and exhaust) valves themselves, however, being freely movable. In a most general variant, it is possible, if appropriate, to design the valve seat rings or inserts in such a way that the central axis of the valve seat insert inside diameter is shifted off center relative to the central axis of the valve seat insert outside diameter in the direction toward the center of the cylinder head. Further, in this development the valve stem guides are offset toward the center of the cylinder head by the same eccentricity. This can be achieved particularly with the use of valve-stem guide bushings having correspondingly off center holes for the valve stems in relation to the outside diameter. In the preferred embodiment of the invention, however, the valve seat inserts have various seat widths without off-center placement of the various central axes. Thus, no modification or adaptation need be done to the valve stem guides. Breathing valves having reduced valve disk diameters are used with mating valve seat inserts which have reduced inside diameters.

The valve seat inserts, on their breathing duct side, have a shape adapted to the breathing ducts. This shape is designed, in particular, such that no sharp transitions are present that could detrimentally affect the breathing gas flow.

A single design of a cylinder head blank is used for internal combustion engines having unequal bore diameters. The spacings of the cylinder head bore holes and the spacings of the central axes of the valve stem guides in the lengthwise direction of the cylinder head and in the crosswise direction of the cylinder head are the same for all cylinder bore variations of the engine series.

Details that have no effect hereon can thus, of course, be modified. In this way, the cylinder head—regardless of which crankcase it is mated with—can be machined without modifications and with the same tools, the only difference being that different valve seat rings and breathing valves are used according to the cylinder bore diameter of the crankcase. All other parts for attachment to the cylinder head, including the intake lines and exhaust lines, are the same for the series of engines. Thus, the manufacturing cost, and in particularly the diversity of parts, is reduced.

The breathing ducts cooperating with the intake and exhaust valves in the cylinder head are designed for the largest valve seat insert diameter. This ensures that charge forming is optimized for the internal combustion engine having the largest bore diameter or displacement. Normally, however, the quantities (of combustion air) flowing through these breathing ducts are adequate for good charge forming in internal combustion engines having a smaller displacement.

If appropriate, the breathing duct cores may exhibit a smaller diameter in the case of the crankcase having a smaller cylinder bore, at least in the region of the valve seat inserts. Thus there would be no need to use valve seat inserts having a corresponding transitional contour, and, instead, standard valve seat blanks could be employed.

This invention permits the design of the valve actuating means in the crankcase and/or the cylinder head to be the same for all the engines of a series having various bore variations. Thus identical parts, including the camshaft, can be used in a series of engines.

On the whole, by means of the inventive use or design of the cylinder head it is achieved that said cylinder head can be employed for various cylinder bore diameters.

The use of this invention is particularly advantageous when applied to a series of engines of the same basic design. The cylinder head is first developed for the internal combustion engine of the series having the largest displacement. This cylinder head design can then be used for the smaller displacement engines of the series through use of different breathing valves and valve seat inserts.

BRIEF DESCRIPTION OF THE DRAWINGS

An exemplary embodiment of the invention is illustrated in the figures hereinafter described in detail, in which.

DETAILED DESCRIPTION OF THE DRAWINGS

Figure 1:
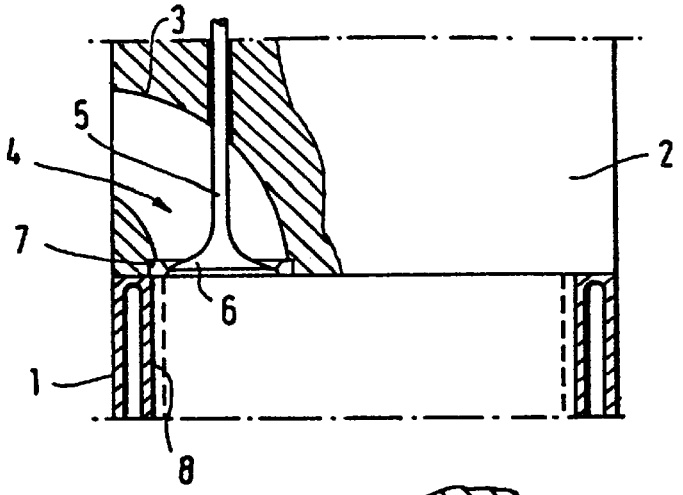
FIG. 1 is a schematic representation of a cylinder head placed on a cylinder.

As shown in FIG. 1, the cylinder 1 of an internal combustion engine, in particular a multicylinder internal combustion engine of inline or V type, is covered by a cylinder head 2, shown schematically. The parts shown of the cylinder head include a breathing duct 3, a valve seat ring 7 and a breathing valve 4, shown partially. The valve stem 5 of the breathing valve 4 is guided in the cylinder head 2 in a valve stem guide, not shown, while the valve disk 6 cooperates with the valve seat ring or insert 7, which is inserted into the cylinder head 2. The position and size of the valve disk 6 and of the valve seat insert 7 are selected such that the breathing valve 4 offers the largest possible flow cross section to the breathing duct 3.

Accordingly, the breathing valve 4 extends nearly to the cylinder face 8. If a cylinder 1 having a slightly smaller bore is employed (dashed lines), it would no longer be possible to open and close the breathing valve.

Figure 2:
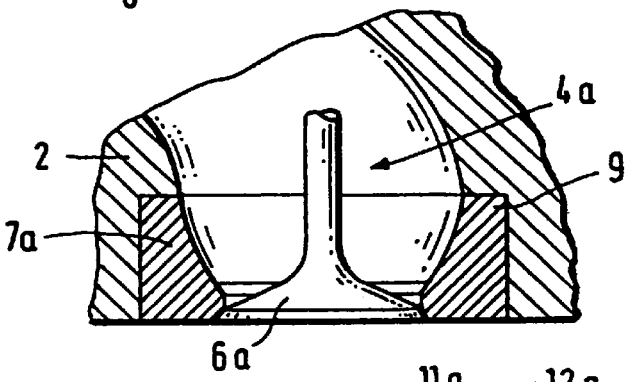
FIG. 2 is a section showing a breathing duct into which a valve seat insert for a breathing valve having reduced valve disk diameter is inserted.
Figure 4:
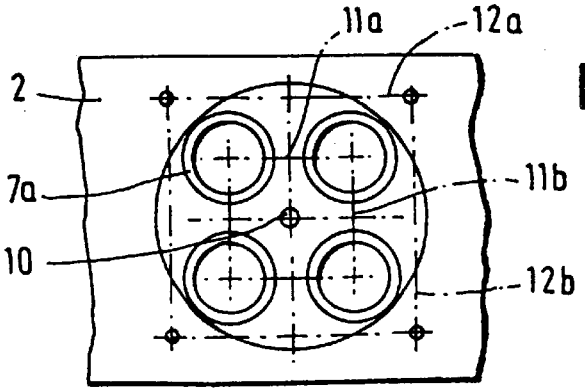

For the engine with a smaller cylinder bore, as shown in FIG. 2 and FIG. 4, a valve seat inset 7*a* having a greater seat ring width is inserted into the cylinder head 2 and a mating breathing valve 4*a* having a smaller diameter valve disk 6*a*, as compared to the breathing valve 4, is used. For an aerodynamically favorable transition, the valve seat insert 7*a* uses a transition shape 9, which ensures a favorable transition to the inside wall of the breathing duct. In place of this valve seat insert 7*a* having a transitional shape 9, an adapted breathing valve core having a smaller diameter, at least in this region, can also be employed in the casting of the cylinder head 2. Furthermore, the dash lines in FIG. 2 show the valve seat insert having a smaller seat ring width for a large cylinder bore engine.

Figure 3:
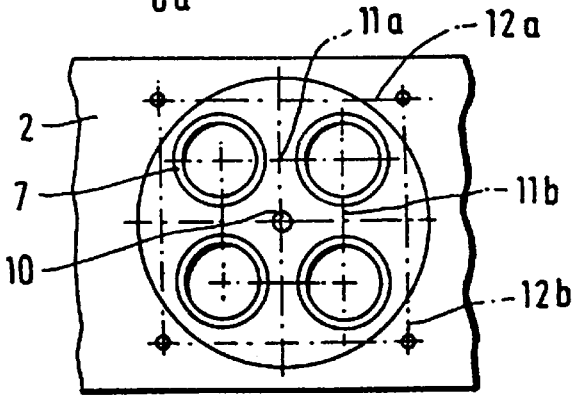
FIG. 3 is a schematic view of the cylinder head on the combustion chamber side cooperating with a large cylinder bore diameter and FIG. 4 is a view similar to FIG. 3 but showing a smaller cylinder bore diameter and valve seat inserts with smaller interior diameter.

FIGS. 3 and 4 each show a view of the cylinder head 1 on the combustion chamber side cooperating with various bore diameters of the cylinders 1. A design of the cylinder head 2 having valve seat inserts 7 having smaller valve-seat-ring width for a large bore diameter cylinder 1 is shown in FIG. 3. FIG. 4 shows a design of the cylinder head 2 having valve seat inserts rings 7*a* having large ring width for a smaller bore diameter cylinder 1. The central hole 10 is an opening in particular for an injection valve, a spark plug also being employable in this opening if appropriate, since the invention is applicable both to autoignition internal combustion engines and to spark-ignition Otto or gasoline internal combustion engines. The spacings 11*a*, 11*b* of the central axes of the breathing valves 4, 4*a*, as well as the spacings 12*a*, 12*b* of the central axes of the cylinder head mountings (cylinder head bolt holes), remain the same for the series of engines having different cylinder bore diameters.

What is claimed is:

1. An internal combustion engine of the type having a crankcase in which a cylinder is formed and in which there is rotatably supported a crankshaft, to which there is articulated at least one connecting rod connected to a piston movable in said cylinder, said cylinder having a diameter selected from a predetermined range of diameters between large and small diameters, said engine comprising:

a cylinder head secured to said crankcase in covering relation to said cylinder so as to form a combustion chamber, said cylinder head including cylinder head mounting bolt holes, at least one intake valve and one exhaust valve, each of said valves having a valve stem and a valve disc, a valve seat recess for each of said valves, a valve seat insert in each of said valve seat recesses, a pair of valve stem guide openings for receiving said valve stems, said cylinder head mounting bolt holes, said valve stem guide openings and said valve seat insert recesses having constant dimensions and positions for all combinations of said cylinder head and said crankcase with cylinder diameters being variably selected from said predetermined range of cylinder diameters for said crankcase.

2. The internal combustion engine of claim 1 wherein said crankcase has a cylinder with said large diameter and wherein said valve disks (6) extend into the cylinder peripheral region of the part of said (cylinder head (2) cooperating with said cylinder head) to form said combustion chamber.

3. The internal combustion engine of claim 1 wherein said valve seat insert extends slightly beyond the upper edge of said cylinder.

4. The internal combustion engine of claim 1 wherein said cylinder head includes a breathing duct (3) and said valve seat inserts (7*a*) in said cylinder head are shaped to provide a low turbulent flow transitional shape (9) to said breathing-valve duct (3).

5. The internal combustion engine of claim 1 wherein the arrangement of the valve actuating means in the crankcase and/or the cylinder head (2) is the same for all crankcases having cylinder diameters in the range between said large and small diameters.

6. An internal combustion engine including a crankcase having a cylinder and a rotatably supported crankshaft, to which there is articulated at least one connecting rod, which bears a piston movable in a cylinder, a cylinder head secured to said crankcase in covering relation to said cylinder so as to form a combustion chamber, at least one intake valve and at least one exhaust valve inserted in said cylinder head, each of said valves housing a valve disk which extends into said combustion chamber when said valve is actuated, characterized in that:

said cylinder head (2) is usable for internal combustion engines having crankcases presenting cylinders of a bore diameter variably selected from a range of bore diameters between predetermined large and small bore diameters, said cylinder head (2) including spaced cylinder-head mounting bolt holes, spaced valve stem guide openings, spaced breathing valves (4, 4*a*) with valve disks (6) with a diameter variably selected from a range of disk diameters between predetermined large and small disk diameters and having valve stems extending into said valve stem guide openings, valve seat recesses (7) in said cylinder head and valve seat inserts (7*a*) in said valve seat recesses in mating relation to said valve disks (6), the dimensions and locations of said cylinder head mounting bolt holes, said valve stem guide openings and said valve seat recesses being constant for engines with crankcases having cylinders within said range of predetermined large and small bore diameters and for engines with valve disks having diameters within said range of disk diameters.

* * * * *